US006083309A

United States Patent [19]

Tomlinson

[11] Patent Number: 6,083,309

[45] **Date of Patent: *Jul. 4, 2000**

[54] GROUP IV-A PROTECTIVE FILMS FOR SOLID SURFACES

[75] Inventor: Charles E. Tomlinson, Martinsville, Ind.

[73] Assignee: Natural Coating Systems, LLC, Martinsville, Ind.

[ * ] Notice: This patent is subject to a terminal disclaimer.

[21] Appl. No.: 09/302,575

[22] Filed: Apr. 30, 1999

Related U.S. Application Data

[63] Continuation-in-part of application No. 09/013,368, Jan. 26, 1998, Pat. No. 5,952,049, which is a continuation-in-part of application No. 08/723,464, Oct. 9, 1996, Pat. No. 5,759,244, and a continuation-in-part of application No. PCT/US98/24700, Nov. 20, 1998.

[51] Int. Cl.[7] ..... C23C 22/05

[52] U.S. Cl. ..... 106/14.21; 106/14.11; 106/14.12; 106/14.13; 106/14.14; 106/14.15; 106/14.16; 106/14.17; 106/14.44; 148/243; 148/247; 148/275

[58] Field of Search ..... 106/14.11, 14.21, 106/14.44, 14.12, 14.13, 14.14, 14.15, 14.16, 14.17; 148/243, 247, 275

[56] References Cited

U.S. PATENT DOCUMENTS

| | | | |
|---|---|---|---|
| 3,123,452 | 3/1964 | Harris et al. | 51/307 |
| 3,864,139 | 2/1975 | Heller | 106/287.19 |
| 3,864,163 | 2/1975 | Beer | 148/242 |
| 3,969,152 | 7/1976 | Melotik | 148/256 |
| 4,338,140 | 7/1982 | Reghi | 148/247 |
| 4,359,347 | 11/1982 | Da Fonte, Jr. | 148/270 |
| 4,462,842 | 7/1984 | Uchiyama et al. | 148/247 |
| 4,470,853 | 9/1984 | Das et al. | 148/247 |
| 4,614,607 | 9/1986 | Loch | 510/257 |
| 4,863,706 | 9/1989 | Wada et al. | 423/277 |
| 5,034,358 | 7/1991 | MacMillan | 501/106 |
| 5,128,065 | 7/1992 | Hollander | 252/394 |
| 5,156,769 | 10/1992 | Cha et al. | 252/395 |
| 5,192,374 | 3/1993 | Kindler | 148/272 |
| 5,194,138 | 3/1993 | Mansfeld et al. | 205/183 |
| 5,209,788 | 5/1993 | McMillen et al. | 148/247 |
| 5,266,358 | 11/1993 | Uemura et al. | 427/376.2 |
| 5,322,560 | 6/1994 | DePue et al. | 106/404 |
| 5,346,722 | 9/1994 | Beauseigneur et al. | 427/300 |
| 5,362,335 | 11/1994 | Rungta | 148/272 |
| 5,380,374 | 1/1995 | Tomlinson | 148/247 |
| 5,385,655 | 1/1995 | Brent et al. | 204/181.1 |
| 5,397,390 | 3/1995 | Gorecki | 106/287.11 |
| 5,399,210 | 3/1995 | Miller | 148/273 |
| 5,441,580 | 8/1995 | Tomlinson | 148/247 |
| 5,449,414 | 9/1995 | Dolan | 148/247 |
| 5,525,560 | 6/1996 | Yamazaki et al. | 501/103 |
| 5,578,176 | 11/1996 | Hardee et al. | 204/290 R |
| 5,662,746 | 9/1997 | Affinito | 148/247 |
| 5,711,996 | 1/1998 | Claffey | 427/388.4 |
| 5,759,244 | 6/1998 | Tomlinson | 106/14.14 |
| 5,789,085 | 8/1998 | Blohowiak et al. | 428/450 |

FOREIGN PATENT DOCUMENTS

| | | |
|---|---|---|
| 1 504 494 | 3/1978 | United Kingdom . |
| 2 084 614 | 4/1982 | United Kingdom . |

OTHER PUBLICATIONS

Connick et al., *J. Am. Chem. Soc.* vol. 71, The Aqueous Chemistry of Zirconium (Sep. 1949), pp. 3182–3184, 3186–3187, and 3190–3191.

Chang, *Westinghouse Paper*, (1996–1997), pp. 1–6, No Month.

Greenwood et al., *Chemistry of the Elements*, (1984) p. 1425, No Month.

Kendig et al., *Corrosion Science*, vol. 34, No. 1, The Mechanism of Corrosion Inhibition by Chromate Conversion Coatings from X–Ray Absorption Near Edge Spectroscopy (Xanes), (May 1992), pp. 41–49.

Nebergall et al., *General Chemistry 6th Ed.*, Convalent and Ionic Radit of the Elements (1980), No Month.

Thomas et al., *J. Am. Chem. Soc.* vol. 57, Basic Zirconium Chloride Hydrosis (Oct. 1935), pp. 1825–1828.

Tomlinson, *Cadmium and Chromium Alternatives: An Information Exchange*, (Nov. 5–7, 1997) p. 30.

Lewis Research Center, *NASA Tech Briefs*, Materials (Jan. 1998), p. 68.

Peters, (*Semiconductor International*), Pursuing the Perfect Low–K Dielectric, Sep. 1998, pp. 64–74.

Nasa Tech Briefs, Jan. 1998, p. 68.

Abstract, Flynn, (*JMEMS*, 1 (1) (1998), p. 44, Piezoelectric Micromotors for Microrobots, No Month.

Flynn, et al. Journal of Microelectromechanical Systems, vol. 1, No. 1, *Piezoelectric Micromotors for Microrobots* (Mar. 1992).

*Primary Examiner*—Anthony Green
*Attorney, Agent, or Firm*—Leydig, Voit & Mayer, Ltd.

[57] ABSTRACT

Compositions and processes are disclosed for producing improved electrical insulation, environmental protection, corrosion resistance and improved paint adhesion for metals; e.g., ferrous, aluminum, or magnesium alloys; as well as other substrates such as anodized metals, glasses, paints, plastics, semiconductors, microprocessors, ceramics, cements, silicon wafers, electronic components, skin, hair, and wood upon contact. The compositions and processes comprise use of one or more Group IV-A metals, such as zirconium, in combination with one or more non-fluoanions while fluorides are specifically excluded from the processes and compositions above certain levels. The processes can contain pretreatment stages that serve to activate a substrate surface and/or promote formation of metal- and mixed-metal oxide matrices through use of an oxygen donor. The compositions are at a pH below about 5.0 and are preferably in a range between about 1.0 and about 4.0. The coatings may contain additives such as surfactants, sequestering agents, or other organic additives for improved corrosion protection and paint adhesion. The substrate may be treated by immersion, spray, fogging or rollcoat and other common application techniques.

39 Claims, No Drawings

GROUP IV-A PROTECTIVE FILMS FOR SOLID SURFACES

This application is a continuation-in-part-application of U.S. patent application Ser. No. 09/013,368 filed on Jan. 26,1998, now U.S. Pat. No. 5,952,049 which was a continuation-in-part of U.S. patent application Ser. No. 08/723,464, filed on Oct. 9, 1996, now issued as U.S. Pat. No. 5,759,244. This application is also a continuation-in-part of PCT application Ser. No. PCT/US98/24700, filed on Nov. 20, 1998. These prior applications and the contents thereof are incorporated herein by reference in their entireties.

TECHNICAL FIELD OF THE INVENTION

The present invention pertains generally to coatings and seals for metals and other solid substrate surfaces such as glasses, paints, plastics, cements, roofing, semiconductors, anodized metals, microprocessors, silicon wafers, electronic components, skin, hair, teeth and wood. In particular, the present invention relates to coatings that are particularly effective in protecting metals that are prone to pitting corrosion. For example, the present invention has shown to be particularly effective for protecting high copper alloys of aluminum.

BACKGROUND OF THE INVENTION

In recent years a need arose for coating compositions that function to replace chromates in metal treatment. This is due to the detrimental health and environmental impact that has been determined to be associated with chromium compounds in particular. There is also a need for an alternative replacement coating that is formed from an aqueous solution. This eliminates the disposal and emission considerations involved in producing zirconates and other metal oxide-containing coatings from sol-gel applications, while providing a broad-spectrum replacement for undesirable metal treatments such as chromates and molybdates.

There are believed to be several mechanisms by which chromates provide protection to an underlying substrate. While the complete source of the protection has not been fully elucidated, there has been considerable research to identify each aspect of the chromate mechanistic model. In *Corrosion Science*, 34 (1), 41 (1993), Kendig, Davenport and Isaacs used XANES to demonstrate variable valence states of chromium in chromate coatings. This revealed both the +3 and +6 oxidation states. The chromium in both states is present as oxides. The +3 state forms a stable "long-range" oxy-polymer and the chromium remaining in the +6 state, which is trapped in the film, has limited long-range structure.

The protection would then come from at least two mechanistic aspects. One is the physical aspect of protection provided by the stable +3 oxide matrix. A secondary protective source is the +6 chromate in the film. The trapped reservoir of +6 chromate is in some way available to heal the film in some fashion once corrosive attack begins.

Many chromate-free chemical conversion coatings for metal surfaces are known to the art. These are designed to render a metal surface "passive" (or less "reactive" in a corrosive environment), leaving the underlying metal protected from the environment. Coatings of this type that produce a corrosion resistant outer layer on the base metal or its oxide often simultaneously produce a surface with improved paint adhesion. Conversion coatings may be applied by a no-rinse process, in which the substrate surface is treated by dipping, spraying, or roll coating. The coatings may also be applied in one or more stages that are subsequently rinsed with water to remove undesirable contaminants.

Several metal and metaloid elements will form a continuous three-dimensional polymeric metal- or metaloid-oxide matrix from aqueous solutions. Chromium shares this characteristic along with silicon and other elements. The Group IV-A elements continue to be attractive candidates for chromate replacement technologies as they share the virtue of being relatively innocuous environmentally and have common valences of +4, facilitating the formation of three dimensional amorphous coatings.

Non-chrome conversion coatings are generally based on chemical mixtures that in some fashion will react with the substrate surface and bind to it to form protective layers. The layer or layers may yield protection through galvanic effects or through simply providing a physical barrier to the surrounding environment.

Many of these conversion coatings have been based on Group IV-A metals such as titanium, zirconium and hafnium, a source of fluoride and a mineral acid for pH adjustment. Fluoride has typically been considered to be necessary to maintain the Group IV-A and other metals in solution as a complex fluorides. The fluoride may also serve to keep dissolved substrate metal ions (such as aluminum) in solution.

For example, U.S. Pat. No. 4,338,140 to Reghi discloses a coating for improved corrosion resistance with solutions containing zirconium, fluoride and tannin compounds at pH values from 1.5 to 3.5. Optionally, the coating may contain phosphate ions.

U.S. Pat. No. 4,470,853 to Das is related to a coating composition comprised of zirconium, fluoride, tannin, phosphate, and zinc in the pH range of 2.3 to 2.95. According to Das, it is important that approximately 10 atomic percent of zirconium-zirconium oxide be present in the coating to obtain "TR-4" corrosion resistance. It was shown that coatings of higher zirconium oxide content produced excellent corrosion resistance. Compositions which gave higher zirconium oxide on the surface were preferred in the disclosures.

U.S. Pat. No. 4,462,842 to Uchiyama and U.S. Pat. No. 5,380,374 to Tomlinson disclose zirconium treatments in solutions containing fluorides which are followed by treatment with silicate solutions. This combination is suggested to form zirconate and syloxyl linkages (—O—Zr—O—Si—O—Si— . . . ), yielding a coating with improved corrosion resistance over the zirconium treatment alone. Coatings of this type give excellent corrosion protection but very poor paint adhesion.

The compositions and processes of Uchiyama are useful in producing hydrophilic surfaces. The compositions of Tomlinson purportedly do the same when subsequently treated per Uchiyama. The compositions of Tomlinson are high in Group II-A metals, which somewhat improve the latent corrosion protection of the fluoro-Group IV-A coating formed. The drawback is that the solubility of Group II-A components is limited, therefore the opportunity to formulate stable concentrates may not be possible.

Additionally, coating compositions high in the Group II-A elements tend to generate considerable scaling as described by Reghi in U.S. Pat. No. 4,338,140. While an incremental improvement in paint adhesion may be afforded by Group II-A metal inclusion in some aspect of the present invention, they may actually inhibit formation of the continuous amorphous metal oxide matrices in some cases.

In Reghi and in U.S. Pat. Nos. 5,380,374 and 5,441,580 to Tomlinson, Group I-A and Group II-A elements probably incorporate as "discrete," non-bonded cations, perhaps providing some space-charge stabilization to balance discrete anions in the coatings. But these compositions likely provide little if any long-range structure.

U.S. Pat. No. 4,863,706 to Wada discloses a process for producing sols and gels of zirconium and a process for producing zirconia. The processes described include reactions to produce basic boratozirconium and basic boratozirconium chloride sols. These were purportedly used in producing boratozirconium and boratozirconium chloride gels. Further described is a method for producing zirconia from the gels at relatively low temperature. The essential components include a boron compound along with a polyvalent metal, zirconium and chloride.

U.S. Pat. No. 5,397,390 to Gorecki discloses an adhesion promoting rinse containing zirconium in combination with one or more organosilanes and fluoride. The compositions are used to rinse surfaces after they have been treated in a phosphating bath. The zirconium ion concentration is selected to maintain pH in a broad range as the silanes deposit on the substrate to promote paint adhesion and improve corrosion resistance. Organosilanes are necessary components of the disclosed compositions. Additionally, in preparing the compositions, Gorecki indicates that whenever zirconium-containing salts such as zirconium basic carbonate, zirconium hydroxychloride and zirconium oxychloride are used as a source (of zirconium) the salts must be dissolved in 50% hydrofluoric acid in order to effect dissolution. Gorecki does not indicate a necessity to dissolve the fluorozirconate salts mentioned in his disclosure. This demonstrates that fluoride is a necessary component of the disclosed compositions as it is included as part of the fluorozirconate salts or from hydrofluoric acid.

Brit. Pat. 1,504,494 to Matsushima describes a process for treating metal surfaces using zirconium at a pH above 10.0. A zirconate coating is formed but the pH of the solution is maintained above the present invention.

U.S. Pat. No. 5,603,754 to Aoki describes the use of zirconium and titanium ions in the presence of fluorides, oxidizing agents and aluminum and other components. The coatings appear to be mixed fluoro-forms of tin, aluminum, zirconium or titanium phosphates. The coatings appear to provide an excellent surface for painting or printing. Fluorozirconates and fluorotitanates are used, indicating a high fluoride to Group IV-A metal ratio.

U.S. Pat. No. 5,759,244 to Tomlinson discloses compositions with fluoride to Group IV-A metal at a molar ratio in the range of less than or equal to two to one and zero to one. The compositions are effective in providing corrosion resistance to many alloys.

U.S. Pat. No. 5,760,112 to Hirota describes an organic coating with carbon black as a pigment, oxidizing ions and, optionally, metal ions. The organic polymer formed from the dispersion upon curing is fundamentally different from the films provided in the present disclosure. But the present invention would provide an inorganic alternative to such compositions in the same pH range using the same application techniques.

One avenue of research into protecting the copper bearing aluminum alloys has been to provide compositions that contain azole derivatives to complex any copper that dissolves during corrosive attack. This can happen through various cells that can be established at copper inclusions at the surface of these alloys. U.S. Pat. No. 5,128,065 to Hollander discloses this type of chemistry. The azoles of this type and some of those disclosed by Cha in U.S. Pat. No. 5,156,769 show some promise.

In addition, many health and environmental benefits of eliminating or reducing fluoride have been addressed in systems based on chemistries other than those of the Group IV-A metals. Examples are described in UK Pat. Application 2,084,614 by Higgins.

In view of the foregoing, it can be seen that there exists a need for an improved "broad-spectrum" coating which can be used in a number of applications, and which is also environmentally sound and has a low impact in the workplace. It will be appreciated that there exists a need for broad-spectrum coating systems which are aqueous, promote paint adhesion and provide environmental resistance simultaneously.

It is an object of the present invention to provide such compositions, as well as certain processes for coating substrates that incorporate said compositions. These and other objects and advantages of the present invention, as well as additional inventive features, will be apparent from the description of the invention provided herein.

BRIEF SUMMARY OF THE INVENTION

The present invention provides aqueous compositions and processes for coating substrates, such as, for example, glasses, metals, paints, plastics, cements, ceramics, roofing, semiconductors, anodized metals, microprocessors, electronic components, skin, hair, wood, and combinations thereof.

The aqueous compositions comprise at least one dissolved Group IV-A element. The compositions also comprise at least one non-fluoanion, and, optionally fluoride in an acidic system. When fluoride is present, it is kept at levels where it least interferes with production of "long-range mixed-metal oxide polymer" yet imparts characteristics such as improved paint adhesion. In no case is fluoride present in an amount such that its bonding, coordination, or complexation yields a ratio of more than four fluoride atoms per Group IV-A atom. Most desirably, the non-fluoanion is a non-oxyanion or oxyanion having a charge-to-radius ratio having an absolute value less than that of fluoride (i.e., 0.735). An oxyanion can be used in conjunction with the non-oxyanion in some embodiments of the invention in such a way that the total moles of oxyanion plus non-oxyanion in the inventive compositions is preferably at least about one-half (i.e., 0.5 times) the total moles of Group IV-A metals. In one embodiment, the anion is a non-oxyanion having the aforesaid charge-to-radius ratio. It is always desirable to use the minimum amount of chemical that proves to be effective for a given desired property. Therefore, when anions are present solely for stabilization and/or solublization of the Group IV-A metal, the theoretical minimum mole ratio (lowest effective anion content possible while maintaining a stable solution) is desirable. To the extent the anion promotes a desired change in the final properties of the film formed, the optimum will be based on its impact on coating performance.

Lower ratios of anion to metal are acceptable so long as the Group IV-A metals remain solvated in aqueous solution. In the higher range of pH, a higher anion ratio is believed to be desirable, whereas a lower ratio is believed desirable at lower pH values. In the preferred pH range, the preferred anion to Group IV-A ratio is about one half mole anion to eight moles of anion per mole Group IV-A metal. Physical properties of the anion, such as relative affinity for Group IV-A metals or valency, will affect the preferred balance for any given system. In some applications, far lower ratios are preferred. Generally, at low pH values lower anion requirements are indicated. At the relatively higher pH values, higher ratios of anion to Group IV-A metal are indicated.

In the preferred pH range of 1.5 to 3.5, the preferred ratio of non-fluoanion to Group IV-A metal is between about 0.5:1 to about 8:1. The total concentration of non-fluoanion (including haloanions, oxyanions, and others alone and in combination) is preferably from about 0.01 molar to about 3.2 molar, based upon Group IV-A metal concentrations from about 0.02 molar to about 0.40 molar.

In accordance with another aspect of the present invention, a process for coating said substrates comprises treating a substrate surface with the compositions and then allowing the compositions to dry on the substrate surface. Preferably, pretreatment stages are used which can be considered to activate and/or condition the substrate surface in preparation of application of the present invention. These steps may include, for example, solvent degrease, aqueous cleaning, deoxidization, anodizing, phosphating, chromating, applying a nonchrome coating and other common surface preparations.

Advantageously, the present invention provides an environmentally sound alternative to chromium-based coatings. The compositions of the present invention provide broad-spectrum replacements for a multitude of applications such as, for example, corrosion resistance, paint adhesion, humidity resistance, sealing porous surfaces and providing electrical insulation from a single system. Additionally, the compositions can be prepared in such a fashion so as to provide enhanced corrosion protection on high-copper aluminum alloys. This is of particular importance to the aerospace industry as these alloys are commonly used in aircraft construction.

DETAILED DESCRIPTION OF THE INVENTION

For the purpose of promoting an understanding of the principles of the present invention, reference will now be made to preferred embodiments and specific language will be used to describe how to make the invention. It will nevertheless be understood that no limitation of the scope of the invention is thereby intended, such alterations and further modifications in the illustrated embodiments, and such further applications of the principles of the invention as illustrated herein being contemplated as would normally occur to one skilled in the art to which the invention pertains.

As described above, it is believed hexavalent chromium trapped in the trivalent chromium oxide film can act to "heal" the +3 chromate film once corrosive attack begins. One aspect of the mechanism may be that the +6 chromate reacts with corrosive elements of the environment, oxidizing them and changing their solubility characteristics. Simultaneously, since the +6 chromate is converted to a +3 chromate in this reaction, the film can be "healed" by the formation of this new, less soluble and "polymerizable" form.

Evidence of this type of phenomenon can be seen on a macroscopic scale in a corrosion chamber. Aluminum which has been coated with a heavy (2.0 or more grams per sq. meter) "yellow" chromate and placed in ASTM B-117 salt spray testing will gradually fade to a lighter yellow with a different hue. This is likely to be due to two phenomena.

One, hexavalent chromium is highly soluble; therefore some will "leach" out of the trivalent chromate matrix and wash away, causing the yellow to fade. It is the solubility of hexavalent chromium that makes it particularly pernicious as it can migrate into an organism, being solvated. After passing into the organism it is carried to various locations. At any given time, the hexavalent chromium can oxidize organic material, including genetic coding, and disrupt cellular function. Once the reduction to trivalent chromium has occurred, this less soluble and more toxic trivalent form is present to cause even more harm to the organism.

Secondly, some of the hexavalent chromium will migrate within the layer and act as an oxidizing agent to chloride or other corrosive component of the environment, thereby lending a more greenish hue as the hexavalent chromate is reduced to the trivalent form. With the change in oxidation states, less soluble forms of each element are produced within a pit, often effectively sealing it. This type of action (precipitative) is mimicked by chrome phosphates where the trapped phosphate, while not changing oxidation state, will form insoluble salts with base metal dissolving into a pit, again, providing a "sealing" component to the film.

The combination of Group IV-A elements with stabilizing aquo-anions in the presence of little or no fluoride have now proven to be compositions that will begin displacing chromates in many applications. These follow the trivalent chromate oxide matrix model, lending a physical barrier to the surface they protect. It has been shown that inclusion of "precipitating" agents such as phosphates can extend the protection of these low-fluoride Group IV-A coatings. This is typically done by incorporating these components through use of pretreatment stages.

If the model that includes a reservoir of oxidative component trapped in the film (+6 chromate) is accurate, an analogous component in the Group IV-A matrices should take protection up significantly.

Through direct combination of an oxidative component with Group IV-A metals, it is believed that the present invention has individual aspects to mimic most or all of the positive, protective aspects of conversion coatings based on hexavalent and trivalent chromium chemistry while being considerably safer for the workers supervising the processing. The present invention employs an organic or inorganic non-fluoanions to stabilize one or more Group IV-A elements in an aqueous acidic solution. With exposure of a surface to the solution production of a barrier of metal oxide coating is realized.

The compositions of the present invention produce coatings, for example, that are viable for replacing chromate coatings in any aluminum application, including sealing anodized aluminum. They have proven to be highly effective in forming a protective coating on all solid substrates on which they have been tested to date. This includes metal alloys, plated metals, glasses, paints, plastic, wood, roofing and others.

At the same time the present invention provides an environmentally sound alternative that is superior to chromate and other chemical processes in its worker safety attributes. Additionally, the present systems provide an alternative that require no additional or exotic manufacturing equipment. They drop-in to existing equipment, even if a single treatment stage is all that is available.

Such coatings on glass may filter light rays harmful to the human eye. There is a multitude of significant applications for protective coatings in these areas which go beyond corrosion protection. But, the protection that can be lent to woods and paints to the chemical environment is in and of itself extremely important. Additional protection of this nature can come from inclusion of fluorescent dyes such as fluorecein and or pigments such as carbon black into the present invention. Additives of this type in low- or no-fluoride Group IV-A compositions may be used, for example, to protect wood or painted substrates from the deleterious effects of ultraviolet light while providing a physical barrier to water. The additives can be tailored to absorb specific wavelengths of light.

For surfaces with long-term exposure to sunlight, this can considerably increase useful life. In wood applications, the zirconium-oxygen polymer forms and bonds to the wood fibers. This is a fixed hydrophobic layer sealing out rain, seawater, humidity, and other sources of hydration. The pigment present, trapped in the zirconyl matrix, would "seal" out harmful electromagnetic spectrum radiation, such as, for example, ultraviolet wavelengths of light. Compositions of this type would provide superior protection and while being a water-based alternative to VOC-bearing solvent-based systems now in use.

Such compositions could be applied to a finished production unit and give comprehensive, broad-spectrum protection. Addition of pigments and dyes can also assist in process control as they can easily be tracked to monitor overall compositional concentration in process and final coating thickness.

Such compositions could provide a dual purpose in anodization applications. By adding coloring (pigmenting) agent to the Group IV-A compositions, anodized metal exposed to the compositions would have the pores formed in the anodization process filled with the zirconate-pigment mix. Any suitable pigment can be utilized. Optionally, the pigment can be a fluorescent compound. Strictly by way of example, and not limitation, the pigment can be in the form of carbon black. Upon drying, the pigment would be fixed in the zirconyl matrix. Thereby coloration and environmental protection could be obtained in a single processing stage. Typically, in coloration of anodized materials, a sealing stage containing nickel or chromium solutions are used after a pigmentation stage to "seal" the pigment into the pores. Zirconium-based systems as described herein are effective direct-replacement alternatives to these toxic metals. Combining pigment and sealing in a single stage would make the zirconium-based systems even more attractive in anodization applications.

It appears that as the Group IV-A metals react with fluoride, they become considerably less soluble in the range where they reach a nonionic form. It is believed that this is why it is common for prior art to state that compositions containing Group IV-A metals require "at least four fluorine atoms" per Group IV-A atom. This state is effectively a nonpolar, uncharged state (four fluorine atoms per Group IV-A atom) and, therefore, low solubility in a polar system such as water is observed. Having more than four fluorine atoms increases solubility as the Group IV-A complexes become more (negatively) charged as they move up in order to the higher hexafluoro forms, and are, therefore, more highly ionic. The terms "fluoride" and "fluorine" are generally used to designate the ion and the element, respectively. Fluorine also designates the ground state of fluorine ($F_2$, or fluorine gas). Therefore, to avoid ambiguity, the term "fluoride" is used herein to designate one fluorine atom when associated with Group IV-A. In the present invention, the Group IV-A atoms become more (positively) charged as they move to the lower order fluorides (with less than four fluorine atoms associated with each Group IV-A metal atom). Additionally, as has been demonstrated, fluoride competes with oxygen in the process of forming the preferred amorphous mixed-metal oxide coatings.

The relative balance of components in compositions that are stable can be developed by anyone skilled in the art within the desired ranges described herein. The relative molar ratios of Group IV-A metal to fluoride to preferred anion(s) can be determined at any pH in the range disclosed (that being below about 5.0, an acidic solution). The balance, it is to be understood, can be manipulated to bring out desired properties of the film established on any given substrate surface. For metals, it is believed that the compositions will give optimum corrosion protection when no fluoride is present. Characteristics such as adhesivity to paints may improve with the addition of fluoride.

In the present invention, Group IV-A elements are believed to bond to active oxygen atoms on the substrate surface, leading to a thin Group IV-A oxide film forming from a reaction analogous to the reaction of silicates. When the substrate surface is not rinsed before drying, the Group IV-A metal in the coating solution carried out with the substrate will bond to the thin film upon drying. Whereas silica "gels" form from alkaline solutions upon exposure to an acidic surface or one high in mono- and polyvalent cations, Group IV-A "gels" will form on surfaces which are acidic or basic and those high in mono- and polyvalent cations. Upon drying at room or elevated temperature, a continuous polymeric mixed-metal oxide becomes fixed on the surface.

The present compositions and processes will give improved corrosion protection over Group IV-A coatings containing fluoride in a ratios of greater than two fluoride atoms per Group IV-A. This is believed to be due to the fluoride competing with oxygen for bonding to the metals in the matrix. With an atomic ratio of fluoride to Group IV-A atom at or between two to one and zero to one, the probability that all metal atoms will incorporate in the coating as an oxide is higher than for systems containing higher fluoride levels. The term "order" is used herein to describe the number of bonds a given metal element has to another element such as oxygen or fluorine; i.e., a second order zirconium fluoride has zirconium bonded to two fluorine atoms, a third order zirconium-oxygen compound has three oxygen to zirconium bonds, etc. With no fluoride present to compete with the oxygen, a three-dimensional metal oxide matrix with each metal atom bonded with up to four oxygen atoms will be established. Naturally occurring zirconates having this character are among the hardest, oldest and most stable inorganic compounds known.

Studies by Connick and McVey (*J. Am. Chem. Soc.*, Vol. 71, 1949, pp. 3182–3191) demonstrated that fluoride complexes of zirconium are far more stable than any other complexes (oxyanion and chloride) in their studies. It is this high stability of the fluocomplexes which interferes with Group IV-A oxide polymer formation. Its presence diminishes the Group IV-A to oxygen bond density (number per unit volume) and thereby decreases the protective ability of the metal oxide film. It is to be noted that Connick and McVey included chloride in the study and found its affinity to be on a par with the nitrate oxyanion.

Thomas and Owens (*J. Am. Chem. Soc.* Vol. 57, 1935, pp.1825–1828) found nitrate and chloride anions to be comparable in many regards in their studies of zirconium hydrosols and developed a hierarchy for the tendency of anions to coordinate with zirconium. Again, fluoride was very high while nitrate and chloride were very low. The only anion stronger than fluoride was hydroxide. In the present invention, the formation of Group IV-A hydroxides is intended with eventual dehydration reactions leading to zirconyl-, titanyl- or hafnyl-oxide matrices.

With regard to non-fluoride anions (such as chloride) which may be suitable for stabilizing Group IV-A metals in aqueous solution yet still allowing the formation mixed-metal oxide matrices upon drying, the absolute value of charge to ionic radius ratio is the criterion for inclusion or exclusion in the group of preferred anions. For example, for a monatomic anion such as chloride with a charge of negative one and a radius of 1.81 Angstroms (According to Nebergall, Holtzclaw and Robinson, in: "*General Chemistry*," Publisher, D. C. Heath and Co., 1980) the value is $|-1/1.81|$ or 0.552. For fluoride, the ratio is $|-1/1.36|$ or 0.735. Therefore, it can be seen that when the ratio is below 0.735, the charge to radius (and therefore, overall atomic or molecular charge distribution) is such that the affinity will be lower than fluoride and acceptable for inclusion in the group of anions. An example of an anion excluded from the group would be sulfide with a charge of −2 and an ionic radius of 1.84 Angstrom units, resulting in a ratio of 1.087. Group IV-A sulfides are very stable and typically relatively insoluble as a result. This results in the exclusion of the $S^{2-}$ anion from the group of preferred non-fluoride anions.

In fluo- and non-fluo-polyatomic anions, the radius may be considered to be the bond length between a central and periphery atom(s) (three or more atoms in the polyatomic anion) or simply the bond length in a diatomic anion. As with monatomic non-fluoride anions, the ratio of charge to radius determines the suitability for inclusion in the preferred group. Anions with a ratio having an absolute value below 0.735 (charge to radius) are preferred.

The present invention may be used in processes where fluoride is used in preceding stages. This may cause accumulation of fluoride in the compositions of the present invention in some systems during processing. Fluoride may be tolerated in such cases up to a ratio not exceeding four fluoride atoms per Group IV-A atom in solution. It is to be understood that the presence of such fluoride is usually undesirable for compositions and processes described here but that such systems are still preferred to those with higher fluoride levels. In the prior art, fluoride is typically used at a ratio of at least four fluoride atoms per Group IV-A atom.

It should be further noted that the zirconate coatings containing fluoride are inferior to the same which are subsequently treated with silicate solutions. This indicates the silicate itself is superior to the fluorozirconates for protection and while the fluorozirconates give some benefit, they act primarily as a surface activator and attachment device for the silicate layers.

The present invention provides improved, highly corrosion resistant, environmentally protective and insulative coatings based on Group IV-A metals by combining the metals with a stabilizing anion (oxyanions, haloanions and others) other than fluoride in acidic solution. The presence of fluoride in the solution is typically undesirable but may be tolerated up to a ratio of four fluoride atoms per Group IV-A atoms. Desirably, the inventive compositions include fluorine in a mole ratio of less than: [2× (molar concentration of Group IV-A metal)]. Compositions in the 2 to 4 fluoride atoms per Group IV-A atom have also now been tested in treating solid surfaces. While solubility is limited in this range, and therefore concentrative issues come into play, the compositions so formulated do provide some environmental protection to the treated substrates.

The present invention provides improved mixed-metal oxide coatings for metals such as, for example, steel, magnesium and aluminum alloys (including high-copper alloys of aluminum) thereof, anodized metals, and combinations thereof, as well as coatings for other substrates, such as, for example, cements, glasses, paints, woods, skin, hair, semiconductors, microprocessors, electronic devices and ceramics.

With addition of soluble forms of Group IV-B elements (such as Si, Ge, Sn, Pb) the compositions may be coated onto silicon wafers and replace sol gel PZT compositions and processes for RAM production as described in "Westinghouse Paper," 1996–1997, URL =http://www.mit.edulpeople/changa by Andy Chang. Similar compositions would be useful in production of ferroelectric thin films for piezoelectric motors as described by A. M. Flynn in "Piezoelectric Micromotors for Microrobots," JMEMS,1 (1) (1998) pg. 44. Additionally, the compositions can provide an alternative dielectric that can meet demands for low-k dielectrics in semiconductor applications as described by L. Peters in "Pursuing the Perfect Low-k Dielectric," Semiconductor International, September (1998) pp. 64–74.

The coatings of the present invention are both highly corrosion resistant and simultaneously serve as an adhesion promoting paintbase. This performance is characteristic of chromate and molybdate conversion coatings, but the present invention does not have the environmental hazards associated with these elements. The compositions and processes of the present invention are also advantageous over silicates because silicate coatings generally reduce paint adhesion.

The present invention provides environmentally sound compositions and processes which provide a paint base which is a highly corrosion resistant, environmental barrier coating useful on metal substrates and other surfaces. An example of one surface which could be coated for the benefit of more than one of the protective properties provided by the present invention is described in NASA Tech Briefs, January, 1998, p. 68.

While applicant does not wish to be bound by any one particular theory, it is believed that the most significant source of protection comes from a metal oxide matrix. The matrix that is formed is analogous to a siloxyl network. Such siloxyl networks have been shown to be produced from alkaline silicate solutions upon their contact with an acidic surface followed by drying.

The use of a silicate in the present invention is generally restricted to a pretreatment stage or a subsequent sealing stage. There is a high level of incompatibility of silicates with the present invention in acid systems. Addition of silicates is not preferred in most instances inasmuch as they cause destabilization, precipitation and/or polymerization of the metal oxides. They can be added to the present invention only to the extent that they do not affect solution stability.

Zirconium will be used here as an example for illustrating combinations of Group IV-A metals with less than four fluoride atoms per said metal atom in acidic aqueous systems. A zirconium oxide matrix is formed when the compositions are dried onto a surface. A zirconyl matrix will be composed of $—O—Zr[—O—]_3—Zr[—O—]_3—Zr[—O—]_3$ structures that make up a three dimensional "zirconate polymer."

The invention is believed to be most efficacious when two or more stages are used. The fluoride-free or low fluoride Group IV-A metal solution is typically the final stage and it is preferred that no rinse be used prior to drying. Stages prior to this stage are included to prepare the substrate surface by cleaning and/or activation. The activation can include, for example, deoxidization, application of other types of coatings (chromate, or chromate-free, a zirconium fluoride attachment to an aluminum oxide surface, anodization, an oxidative stage, or a simple cleaning (with a cleaning agent such as a surfactant or a solvent degrease). These treatments may be used alone or in combination with any activation treatment of the naturally occurring oxide that exists on most metals and many other inorganic as well as organic substrates. It is preferred that the surface be clean and the natural oxide remain intact prior to the present invention's application (and be activated in some fashion) as it will promote additional protection from a corrosive environment. It is preferred that the cleaning stage be the activation stage or be the stage prior to the activation stage.

A multiple stage process of more than two stages is most preferred, as improved bonding of the mixed-metal oxide matrix to the surface will be obtained when there has been an activation stage, and improved corrosion protection can be obtained when a supplemental "conditioning" stage is incorporated. The first stage contains a metal fluoride (preferably a Group IV-A metal) to activate the surface, succeeding stages to condition and oxidize components left by preceding stages, and the final aqueous treatment stage typically consists of a Group IV-A metal solution with less than two fluoride atoms per said metal atoms. It is preferred that the oxidizing agent in one stage be one that is oxygen-containing, such as chlorate ion.

In one aspect of one form of processing, fluoride in the initial stage acts to activate the oxidized surface and the Group IV-A metal bonds, facilitating the subsequent metal-oxide-matrix film formation and attachment. It is believed that an oxygen-containing oxidizing agent promotes formation of the metal oxide matrix by serving as a source of oxygen for the metals to bond to in the fluoride-free mixed-metal oxide stage. The oxygen-containing oxidizing agent may be incorporated through use in a pretreatment or through direct addition to the low- and no-fluoride-containing Group IV-A metal stage.

Excessive contamination of the low-fluoride Group IV-A metal stage with prior treatment solutions is to be avoided as they may induce premature gellation when rising to excessively high levels. This is to be avoided, as the treatment bath will be induced to completely and irreversibly gel in the treatment tank.

In one aspect of the present invention, a corrosion resistant conversion coating is provided comprising a Group IV-A metal such as titanium, zirconium or hafnium and an oxyanion such as nitrate, sulfate, acetate, a halo-anion such as chloride, or other anion (alone or in combination) as defined by the charge-to-radius criterion. The anion(s) will coordinate with zirconium but not form stable covalent metal-anion bonds. The anions so described will each have the desired effect in solution with Group IV-A metals whether present at trace or elevated concentrations. They will each be effective and complementary to each other and, therefore, may be used together at any relative ratio to each other. They may be added directly as major raw material components of formulations or as trace components of said raw materials. It is not uncommon to have chloride in nitric acid or water sources, just as nitrates and sulfates are often found in haloacids. These sources of anions all contribute to the cumulative total non-fluoanion content used to coordinate with the Group IV-A metal in solution.

The pH of the solution is preferably below about 5.0, preferably between about 1.0 and about 4.0, and most preferably between 1.5 and 3.5. To adjust the pH to lower levels, it is preferred to use the corresponding acid of the anion (so the counter ion remains consistent), and to raise the pH of a solution. It is preferred to use a metal-free base. As such, hydrogen ion and the anion of the coating composition of the present invention will together comprise a conjugate acid-base pair. At increasing pH values, Group IV-A elements form higher order hydroxides. In the prior art, fluoride anion has been used to compete with hydroxides and hydroxide donors to inhibit formation of Group IV-A metal hydroxides. The stabilizing anions become displaced and various hydroxide species form according to the following reaction, as seen, for example, for zirconium:

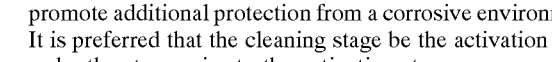

$$Zr^{4+}+nH_2O \rightarrow Zr(OH)_n^{+4-n}+nH^+$$

The higher order hydroxide will, in turn, tend to form $ZrO_2$ which is undesirable because it is insoluble. At a pH of about 4.5 to 5.0 or higher, $Zr(OH)_4$ begins to increasingly predominate, leading to the formation of zirconium oxide through a dehydration reaction. In particular, titanium, in dilute concentrations in the presence of high affinity oxyanions, has proven to be stable to the neutral pH range, but processability and practicability become compromised. Therefore, pH values below 5.0 are generally preferred for broad-spectrum applications. Higher levels of acid in solution (low pH values) push the equilibrium of this reaction to the left and, with sufficient anion(s) present, $Zr^{4+}$ remains soluble in solution and does not precipitate as the oxide ($ZrO_2$) formed dehydration reactions of the higher order hydroxides.

A proton from an acid can be considered to be competitive with the zirconium ion for a hydroxyl unit, yielding water and a soluble zirconium/hydroxyl/anion complex. This can be expressed by (with OA representing an oxyanion or other nonfluoride anion):

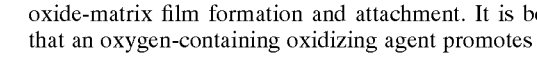

$$Zr(OH)_x^{+4-x}+nH^++mOAY^- \rightarrow Zr(OH)_{x-m}(OA)_m^{+4-m[y]-(x-m)}+nH_2O$$

Addition of an acid such as nitric is ideal for this as hydrogen ion is added along with nitrate, so, for example:

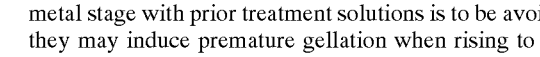

$$Zr(OH)_x^{+4-x}+nHNO_3 \rightarrow Zr(OH)_{x-n}(NO_3)_n^{+4-n-(x-n)}+nH_2O$$

Without high levels of fluoride, the acid and coordinating non-fluoride anion levels must be kept such that the pH is below about 5.0 and the anion is maintained at a level that it helps to form a soluble coordinate complex with the Group IV-A metals. The nature of the anion is important as relatively weak Lewis bases will coordinate with the metals but also allow them to easily form a coating when exposed to a substrate surface. Thus, it is least desirable, but acceptable, to add directly in these applications the very strong Lewis base, hydroxide ion, as it will consume hydrogen ion and begin to compete with the preferred anions for coordination or attachment to the metals. This competition becomes increasingly strong (or more favorable) for hydroxide as pH goes up, reflecting a higher hydroxide concentration (and lower hydronium ion) and, therefore, higher probability of higher order metal hydroxides forming. This, in turn, leads to premature gellation or formation of the insoluble dioxides ($TiO_2$, $ZrO_2$ and $HfO_2$) through dehydration reactions.

The source of the anion may be from various salts such as, for example, potassium nitrate, potassium nitrite, sodium sulfate, sodium acetate and others, but it is generally preferred that the solutions have minimal levels of cations such as potassium. One exception to this is lithium salts and carbonates. $Li^+$ has proven to be very soluble in the compositions described herein. Lithium carbonate has proven to be an excellent pH modifier for these solutions. Additionally, lithium has some hydrolytic properties that make its inclusion preferred in certain compositions and processes described here. In addition, other Group I-A metals and/or Group II-A metals can be incorporated into the inventive composition alone or in combination as well as in conjunction with lithium.

If a haloanion or other preferred anion is to be used, similar Group IA salts are acceptable, as is dissolution of Group IV-A elements in a fluoride-free haloacid such as HCl, HBr, HI, etc.) Therefore, preparation of a zirconium is preferably performed with zirconium form of the carbonate or other relatively pure form such as the metal in combination with the acid form of the anion.

Solubilities and reaction times will depend upon the acid used. Nitric and hydrochloric acid will react quickly and give high solubility, whereas boric acid will react slowly and give low solubility. Nitrates, sulfates and other salts of Group IV-A metals are available and may be used while subsequently lowering the pH, when necessary, using the corresponding acid. Increasing the pH is preferably done using a pH modifier such as a metal-free base, preferably an organic oxygenaceous or nitrogenous Lewis base.

Some azoles (metal-free nitrogenous bases) or other chelants can be optionally included in the compositions of the present invention. Such azoles or other chelants are desirable when they exhibit some solubility in the present invention and, as such, will bind copper ion, thereby potentially providing a benefit when treating high-copper aluminum alloys. Of particular note are the mercapto-azoles. These are very effective for alloys containing Group I-B and II-B metals such as copper and zinc, respectively. Use of Tris is preferred in one embodiment as it will act as a chelant as well as a buffer. Use of the corresponding oxyacid with carbonates of Group IV-A is preferred in one embodiment.

As indicated, the Group IV-A metal may be titanium, zirconium or hafnium or any combination thereof. In most applications zirconium is used, due primarily to its commercial availability and lower cost. Additionally, solutions prepared with titanium would generally have to be more dilute than zirconium and hafnium due to its generally lower solubility.

The levels of acid, anion, and chelants such as ethylenediaminetetraacetic acid, which is commercially available under the trademark of Versenex®, are maintained to keep certain metals in solution.

As silicates tend to gel readily below a pH of 10, it is expected that the Group IV-A elements in the presence of non-fluoride anions will behave analogously above a pH of about 4.5 to 5.0. Therefore, to be in a pH range where gellation is facilitated yet the solution is stable, a pH of 1.0 to 4.0 will be most appropriate. As with silicates, the addition of cations (particularly polyvalent) in the inventive compositions can promote gellation and are acceptable in the coating solution to a limited extent, but are preferably introduced to the surface of the treated substrate prior to its exposure to the present invention. Therefore, in one embodiment, a pretreatment stage is used to accomplish this.

As with most barrier and conversion coatings, an elevated temperature of the treatment solution accelerates coating deposition. Here and in other references, inorganic silicates in water have been shown to form a coating in less than five minutes from about 20 to about 50° C. The higher temperature ensures completeness of reaction and accordingly a range of about 40° C. to about 55° C. is preferred in one embodiment of the present invention. Appropriate working solution temperatures for particular applications may be selected by persons skilled in the art and are not limited to the ranges described herein.

Acceptable coatings will form from solutions up to the solubility limit of the metals at a given pH. In the preferred range of pH, the best levels can be determined without undue experimentation by persons skilled in the art. The best concentration of metals, anion, and hydronium ion, and fluoride will depend upon working bath temperature, method of application, substrate, desired properties etc.

Additional inorganic components may be added to enhance particular characteristics, such as paint adhesion or more rapid coating deposition. These would include phosphates, various cations, etc. Addition of metal and/or metalloid oxides may be useful in certain applications as they will incorporate into the matrix and modify the thermal stress characteristics of the coating. By way of example, desirable metal and metalloid oxides include, but are not limited to, aluminum, lithiates, borates, phosphates, silicates, stannates, germanates, plumbates, chromates, molybdates, zincates, tungstates, manganates, permanganates, other transition metals, and combinations thereof. Studies of zirconium-tungsten oxides have shown geometric expansion upon cooling, which can relieve stress crack formation in the coatings as they cool when they are dried at elevated temperature. Use of any additive will need to be balanced with how it destabilizes the coating solution. Silicates added would tend to destabilize the solutions even at near trace levels; this presents problems in preparing concentrates of the compositions. Silicates may be added to their "solubility" limits, but these levels are generally so low as to render the addition to be of no effect. Similar considerations are to be made for the stannates. They have attractive features, particularly for ferrous substrates, but they can be destabilizing.

One class of organic additives which have shown to be useful in several ways is that of oxygenated water-soluble compounds, such as, for example, siloxanes, silanols, hydroxylated organic compounds, and combinations thereof. Under certain conditions less soluble organic oxygenates such as, for example, polyols, epoxides, esters, urethanes, or acrylics may be added. Of particular benefit are organic oxygenates which are hydroxylated, such as, for example, polyvinyl alcohols, and combinations thereof. Examples include BASF 1,6 hexanediol, Arcosolv® PTB and Air Products and Chemicals' Airvol® 125 polyvinyl alcohol (PVA). It is believed the hydroxyl functionality reacts with the Group IV-A hydroxylate and copolymerizes into the mixed-metal oxide matrix. This lends improved geometric stress tolerance to the coatings and increases the hydrophobic nature of the matrix. Of particular benefit are the highly hydrolyzed polyvinyl alcohols, one of which is mentioned above.

The coatings disclosed here are typically used as "dry-in-place" compositions. This can lead to "puddling" of the coating where it drains during drying. When an organic hydroxylate such as, for example, polyvinyl alcohol is added, the heavier "puddled" area shows excellent continuity after drying. These compositions lend considerably improved paint adhesion, and improved corrosion protection, at very low Group IV-A concentrations. They can be effective even when the Group IV-A metal is at or about micromole ($1.0\times10^{-6}$) per liter levels. Similar synergistic effects can be expected at higher Group IV-A metal concentrations, such as, for example, 0.02 to about 0.4 molar in the inventive compositions.

Corrosion resistance has been shown to be as much as double with use of PVAs in fluoride-free Group IV-A compositions, with as little as 0.0125 weight percent being highly effective. The drawback to their use is that drying usually must occur at elevated temperature or corrosion protection is compromised. Whereas optimum protection can be had by drying at ambient temperatures with compositions void of the organic hydroxylates, temperatures up to about 180° C. are indicated for systems with them. This is, naturally, due to the extra energy required to drive the metal hydroxylate to organic hydroxylate condensation through dehydration reaction.

Generally, as with other Group IV-A oxide coatings, where higher levels of acid help to maintain solubility of bath components, additional acid may be needed to stabilize the coating solution. Incorporation of stannates is also attractive as a structural component and should be of particular value when treating ferrous alloys, as would zincates. While the invention is directed at producing alternatives to coatings containing fluorides and/or chromates and/or molybdates, a small amount of chromium and/or molybdenum may be added as chromate to improve aspects of the coating. For enhanced oxide promotion, it is preferred that safer oxidative components including inorganic oxygenates such as ozone, ozonates, or chlorates as well as organic and inorganic peroxides such as Arco's Chemical Company's tertiary-butyl hydro-peroxide (TBHP), permanganates, hydrogen peroxide and other "per-" forms be added preferentially to Cr 6+ or Mo 6+. In general, inorganic and organic additives should be considered to be necessary at a concentration of at least one one-hundredth the minimum Group IV-A metal concentration; in effect, at least $1\times10^{-8}$ moles per liter. Addition of chromate and other components should be at levels which do not impact the hazard class of the waste generated from processing. This level is currently about 5 ppm chromium.

Working solutions composed of mixture(s) of the above components may be applied by spray, fogging, dip, and roll coat application. After the coating has been allowed to form, it may be rinsed (eg., with water), but a "no-rinse" process is preferred. The Group IV-A components that remain on the surface and are not rinsed off will become incorporated into the coating as it dries. There is an additional benefit in that coating components in solution are not rinsed into the waste stream of the processing facility. A chemical treatment stage may be used after the described treatment to further modify the coating's characteristics. This could include, for example, an oxidizing treatment or a sequence of Group IV-A treatments. In addition, a polymer overcoat or silicate overcoat can be applied optionally to the substrate surface subsequent to the application of the inventive coating compositions.

It will be appreciated by one of ordinary skill in the art that siccative coatings, which form an organic barrier, may also be necessary for decorative or other finishing characteristics of the product. In accordance with an aspect of the present invention, however, the adhesion will be far superior to that seen with silicates as the resultant surface will be acidic rather than alkaline, and fluorozirconates are commonly coated on metals to improve paint adhesion, particularly adhesion of oxygenated polymers such as epoxies and esters. Many of these finishes are commonly applied through electrostatic (e-coat) means. As with conventional application methods, improved adhesion performance would be expected in electrostatic applications.

Reference will now be made to proposed specific examples and how each would improve performance in several applications. It is to be understood that the examples are provided to more completely describe preferred embodiments, and that no limitation to the scope of the invention is intended.

Aluminum (3003 alloy) panels were treated with the pretreatments D and X in Table 1 and rinsed with distilled water after each pretreatment stage. These were then treated with the "Zr-Cl Seal" and oven dried without rinsing.

Three types of control panels were used. Control # 1 was untreated. Control # 2 was treated with Pretreatment-D and oven dried. Control # 3 was soaked for five minutes in distilled water then treated with the Pretreatment-X, rinsed and oven dried as were panels with the Zr-Cl Seal.

Subsequently, the panels were subjected to up to two weeks of ASTM B-117 salt spray testing. All unsealed control panels (Controls #1, #2, and #3) showed corrosion over their entire surface within two days, failing in that period. The panels which were treated with the Zr-Cl Seal passed two weeks of exposure. Passage indicates 0–15% corrosion coverage of surface.

TABLE 1

Compositions used to treat aluminum.

Zr-Cl concentrate (Zr-Cl)

A zirconate conversion coating concentrate solution was prepared with distilled water as follows. 195 grams of zirconium carbonate $3ZrO_2CO_2 \cdot xH_2O$ [assay ~ 40% as $ZrO_2$] slurried into approximately 100 mL distilled water and hydrochloric acid (50 mL of concentrated hydrochloric acid, HCl ~38.0% w/w) were slowly mixed. After the carbonate was completely dissolved, the pH of this solution was less than 0.3. The solution was brought up to 0.4 liter with distilled water. The final pH of this solution was approximately 0.7.

Zr-Cl Seal 1.0 gram of lithium carbonate was added to 100 mL of the Zr-Cl concentrate. The final pH was 1.8. This was brought to 800 mL with distilled water and 0.5 grams of sodium bicarbonate was added. The pH was 2.5.

Pretreatment - D

A five-minute soak in DI water at room temperature (22° C.).

Pretreatment - X

A proprietary 2-stage zirconium fluoride treatment. Stage 1 conditions:5 minutes, 60° C. Stage 2 conditions: 5 minutes, 49° C.

Drying

110° C. for five minutes.

It is clear from Table 2 that an oxidizing stage is very beneficial prior to Group IV-A systems. Addition of an oxidizing agent directly to the seal also promotes formation of the metal oxide matrix, improving the protective properties.

Not shown in the Table 2, but also of note is the surprising observation that a process using $K_2TiF_6$ rather than $K_2ZrF_6$ in a system otherwise identical to that in Table 2 significantly increases the corrosion protection for high copper aluminum alloys such as 2024. Table 2: Results for onset pitting, in a neutral salt spray test, with and without an oxidizer-containing stage prior to a fluoride-free Group IV-A treatment. All processing was identical except the use of an oxidizer in Process 2. The fluoride-free zirconyl stage is an acidic composition base d on zirconium carbonate dissolved in nitric acid.

| Process | Activating Stage Containing $K_2ZrF_6$ | Oxidizer-containing Stage with $NaClO_3$ | Fluoride-free zirconyl Stage | Days to onset of pitting on 2024 aluminum. |
|---|---|---|---|---|
| 1 | Yes | No | Yes | 1 |
| 2 | Yes | Yes | Yes | 3 |

Another unanticipated finding with these systems is that flurotitanates have also proven to be a superior component for inclusion in activation and conditioning stages when treating ferrous metals. Another surprising result along this line has been that a low-fluoride or fluoride-free titanate sealing stage; for example, 2.0 grams per liter potassium titanium oxalate dihydrate at a pH of about 4.0; renders significantly improved corrosion protection and paint adhesion on ferrous substrates over and above that obtained for similar zirconium-based systems.

Surface electrical resistance increases significantly on substrates when treated with systems as described above and when treated with similar zirconium-oxyanion-containing compositions. These should have many applications in the electronics industry as dielectrics. Treating semiconductors with such compositions to reduce cross-talk and power dissipation would be one example of such an application.

All of the references cited herein, including patents, patent applications, and publications, are hereby incorporated in their entireties by reference.

While the preferred embodiments of the invention have been disclosed, it should be appreciated that the invention is susceptible of modification without departing from the spirit of the invention or the scope of the invention.

I claim:

1. A composition for coating a substrate comprising:

a) at least one Group IV-A metal selected from the group consisting of titanium, zirconium, hafnium and combinations thereof, wherein the concentration of said Group IV-A metal is from about $1.0\times10^{-6}$ moles per liter to about 2.0 moles per liter in said composition;

b) at least one anion with a charge-to-radius ratio having an absolute value less than 0.735, or any combination thereof, wherein said anion is present in an amount such that said Group IV-A metal remains soluble;

c) sufficient hydrogen ion in a concentration sufficient to maintain the composition at a pH of less than about 5.0;

d) fluoride atoms which are optionally present in a ratio of zero to four fluoride atoms per Group IV-A metal ion; and e) water.

2. The composition according to claim 1, wherein the at least one anion comprises a non-oxyanion.

3. The composition according to claim 2, further comprising an oxyanion, wherein the total moles of oxyanion plus non-oxyanion in said composition is at least about one-half the total moles of said Group IV-A metals.

4. The composition according to claim 1, wherein the substrate is selected from the group consisting of metals, glasses, paints, plastics, semiconductors, microprocessors, ceramics, cements, silicon wafers, electronic components, skin, hair, and wood and combinations thereof.

5. The composition according to claim 4, wherein the substrate comprises a metal selected from the group consisting of steel, magnesium, aluminum, and alloys thereof, and combinations thereof.

6. The composition according to claim 1, wherein the substrate is a high-copper alloy of aluminum.

7. The composition according to claims 1 or 2, further comprising a water-soluble pigment in sufficient quantity to alter the optical properties of the composition.

8. The composition according to claim 7, wherein the pigment is carbon black.

9. The composition according to claim 7, wherein the pigment is a fluorescent compound.

10. The composition according to claim 1, further comprising at least one water-soluble metal oxide or metalloid oxide in sufficient quantity to enhance the corrosion resistant properties of the composition.

11. The composition according to claim 10, wherein the at least one metal oxide or metalloid oxide is selected from the group consisting of lithiates, borates, stannates, germanates, plumbates, phosphates, silicates, chromates, molybdates, zincates, tungstates, manganates, permanganates, and combinations thereof.

12. The composition according to claim 1, further comprising at least one organic oxygenate in sufficient quantity to enhance the corrosion resistant or adhesion properties of the composition.

13. The composition according to claim 12, wherein the organic oxygenate is selected from the group consisting of oxy-silanes, siloxanes, silanols, polyols, epoxides, esters, urethanes, acrylics or hydroxylated organic compounds, and combinations thereof.

14. The composition according to claim 13, wherein the organic oxygenate is a hydroxylated organic polymer selected from the group consisting of polyvinyl alcohols and combinations thereof.

15. The composition according to claim 1, further comprising at least one Group I-A element in sufficient quantity to enhance the corrosion resistant properties of the composition.

16. The composition according to claim 15, wherein the Group I-A metal is lithium.

17. The composition according to claim 1, further comprising at least one Group II-A element in sufficient quantity to enhance the corrosion resistant properties of the composition.

18. The composition according to claim 17, wherein the Group II-A metal is calcium.

19. The composition according to claim 1, further comprising at least one water-soluble oxidizing agent in sufficient quantity to enhance the corrosion resistant properties of the composition.

20. The composition according to claim 1, wherein the hydrogen ion and the anion are a corresponding conjugate acid-base pair.

21. The composition according to claim 3, wherein the oxyanion is an anion comprising a counter-ion of said Group IV-A metal.

22. The composition according to claims 2 or 3, wherein the non-oxyanion is a counter-ion of said Group IV-A metal.

23. The composition according to claims 1, 2, or 3, wherein the Group IV-A metal is present in a concentration of between about 0.02 M and about 0.4 M of said composition.

24. The composition according to claims 1, 2, or 3, wherein said anion is present in a concentration of between about 0.01 M and about 3.2 M in said aqueous composition and the molar ratio of said anion to Group IV-A metal ion is between about 0.5:1 and about 8:1.

25. The composition according to claim 1, wherein the hydrogen ion comprises hydronium ion in a concentration sufficient to provide a pH between about 1.5 and about 3.5.

26. The composition according to claim 3, wherein zirconium carbonate is a source of the Group IV-A metal and an oxyacid is the source of the oxyanion.

27. The composition according to claims 1, 2, or 3, wherein a fluoride-free form of titanium is a source of Group IV-A metal.

28. The composition according to claim 27, wherein potassium titanium oxalate is a source of titanium.

29. The composition according to claims 1, 2, or 3, wherein zirconium carbonate is a source of Group IV-A metal, and a haloacid is a source of anion.

30. The composition according to claims 1, 2, or 3, further comprising at least one water-soluble chelant in an amount sufficient to complex metals other than or in addition to Group IV-A metals.

31. The composition according to claim 30, wherein the chelant comprises an azole.

32. The composition according to claim 31, wherein the azole is a mercapto-form.

33. The composition according to claims 1, 2, or 3, further comprising a water-soluble pH modifier in an amount in which the pH of said composition is maintained below about 5.0.

34. The composition according to claim 33, wherein the pH modifier is an organic Lewis base.

35. The composition according to claims 1, 2, or 3, further comprising water-soluble cations in an amount sufficient to induce gellation of the composition.

36. The composition according to claim 1, wherein said anion is polyvalent.

37. The composition according to claim 1, wherein the composition includes fluorine in a mole ratio of less than [2×(molar concentration of Group IV-A.

38. The composition according to claim 36, wherein the composition includes fluorine in a mole ratio of less than [2×(molar concentration of Group IV-A.

39. The composition according to claim 4, wherein the substrate is an anodized metal.

* * * * *